US005178527A

United States Patent [19]

Jung

[11] Patent Number: 5,178,527

[45] Date of Patent: Jan. 12, 1993

[54] LUBRICATING APPARATUS FOR SCROLL-TYPE COMPRESSOR

[75] Inventor: Chang H. Jung, Seoul, Rep. of Korea

[73] Assignee: Gold Star Co., Ltd., Rep. of Korea

[21] Appl. No.: 814,382

[22] Filed: Dec. 26, 1991

[30] Foreign Application Priority Data

Dec. 29, 1990 [KR] Rep. of Korea ..... 22449

[51] Int. Cl.[5] ..... F04C 18/04; F04C 29/02

[52] U.S. Cl. ..... 418/55.6; 418/76; 418/81; 418/94

[58] Field of Search ..... 418/55.6, 91, 94, 76, 418/81

[56] References Cited

U.S. PATENT DOCUMENTS

| | | | |
|---|---|---|---|
| 4,065,279 | 12/1977 | McCullough | 62/510 |
| 4,609,334 | 9/1986 | Muir et al. | 418/55.2 |
| 4,946,361 | 8/1990 | DeBlois et al. | 418/55.6 |

FOREIGN PATENT DOCUMENTS

| | | | |
|---|---|---|---|
| 3341637 | 6/1984 | Fed. Rep. of Germany | 418/55.6 |
| 60-116893 | 6/1985 | Japan | 418/55.6 |
| 1300080 | 12/1989 | Japan | 418/55.6 |

*Primary Examiner*—John J. Vrablik

*Attorney, Agent, or Firm*—Ostrolenk, Faber, Gerb & Soffen

[57] ABSTRACT

Lubricating apparatus of a scroll-type compressor comprising a thrust bearing surface provided on a main frame, the surface including a lubricating groove thereon, an orbiting scroll performing an orbital motion under the condition of slide contacting at a lower surface thereof with the thrust bearing surface, a crankshaft having an axial lubricating passage, and lubricating passage included in the orbiting scroll and communicating with the axial lubricating passage of the crankshaft. The lubricating passage comprises a horizontal passage being radially formed as outwardly extending from the inner center of the orbiting scroll and including a stop pin which is inserted into the outer end of the horizontal passage, and also a lower vertical passage being vertically formed as extending from the horizontal passage in order to communicate with the lubricating groove of the main frame. The lubricating apparatus of this invention has advantages in that it simplifies the construction of the compressor, reduces the manufacturing cost, and facilitates the assembling process of the compressor.

4 Claims, 5 Drawing Sheets

LUBRICATING APPARATUS FOR SCROLL-TYPE COMPRESSOR

BACKGROUND OF THE INVENTION

1. Field of the Invention

The present invention generally relates to a scroll-type compressor, and more particularly to a lubricating apparatus for such a scroll-type compressor in which a thrust bearing surface formed on a main frame is supplied with a lubricant, thereby making it possible to support the thrust of an orbiting scroll of the compressor without being provided with a conventional thrust bearing.

2. Description of the Prior Art

As shown in FIG. 1, which shows a conventional scroll-type compressor for compressing, expanding or pumping fluids, for example, a refrigerant gas, the scroll-type compressor is provided with an airtight shell 1, a compressing part 2 and a driving motor part 3, each being enclosed in the shell 1. In addition, a fluid passage for guiding the low pressure fluid, which is subjected to be compressed, toward compression chambers 13 in the compressing part 2 is provided to the compressor. The fluid passage includes a suction pipe 4 formed as penetrating a side wall of the shell 1 and communicating with an external device, for example, an evaporator(not shown) of a refrigerator. On the other hand, there is a discharge pipe 14 provided at an upper end of the compressor in order to guide the compressed fluid of high pressure from the compression chambers 13 to another external device, for example, a condenser(now shown) of the refrigerator.

The compressing part 2 generally comprises a stationary scroll 5, an orbiting scroll 6 being interleaved with the stationary scroll 5, a crankshaft 7 for driving the orbiting scroll 6 in order to cause the scroll 6 to orbit, a balance weight 8 for supporting the eccentric rotation movement of the crankshaft 7, and a main frame 9 for supporting the crankshaft 7 and also receiving the orbiting scroll 6. There is provided a thrust bearing 10 for supporting the orbital motion of the orbiting scroll 6.

The stationary scroll 5 is integrally provided with a wrap 5*a* having a convolution in the form of an involute or a combination of involutes and arcs, while the orbiting scroll 6 is integrally provided with a wrap 6*a* having the same shape as that of the wrap 5*a* of the stationary scroll 5 but with the opposite direction of convolution. The wraps 5*a* and 6*a* of the scrolls 5 and 6 are interleaved with each other in order to define the compression chambers 13 therebetween.

Additionally, an Oldham coupling 11 is disposed between the orbiting scroll 6 and the main frame 9, thereby efficiently restraining the orbiting scroll 6 from freely rotating. The crankshaft 7 has at the upper end thereof an eccentric shaft pin 7*a* which is connected to a downwardly extending hollow shaft of the orbiting scroll 6 by means of an eccentric bushing 12 interposed therebetween. Thus, upon being driven by the crankshaft 7, the orbiting scroll 6 performs orbital motion about a point without rotation, thereby progressively decreasing the volumes of the compression chambers 13 defined by the wraps 5*a* and 6*a*, thus compressing the fluid in the chambers 13. Upon being compressed, the compressed fluid in the chambers 13 is discharged from the compressor to the outside through the discharge pipe 14.

On the other hand, the driving motor part 3 comprises a stator 15 which is secured to the inner wall of the shell 1, and a rotor 16 which is secured to the crankshaft 7. There is provided, at the lower part of the compressor, a lubricant reservoir 17 for containing the lubricant therein. An oil pump 18 is provided to the lower end of the crankshaft 7 so that as the crankshaft 7 rotates, the lubricant in the reservoir 17 is upwardly pumped by the oil pump 18 in order to be supplied to respective sliding contact parts of the compressor.

As described above, the known scroll-type compressor needs to be provided with the thrust bearing 10 for supporting the thrust generated by the relative motion between the stationary and orbiting scrolls 5 and 6 as the orbiting scroll 6 performs the orbital motion thereof in order to compress the fluid in the compression chambers 13 between the stationary and orbiting wraps 5*a* and 6*a*.

In result, the known scroll-type compressors each has disadvantage in that it is obliged to include an auxiliary thrust bearing for supporting the thrust generated by the relative motion between the stationary and orbiting scrolls during the compression of the fluid, thereby causing an additional designing process for the thrust bearing to be needed, and the manufacturing cost to be considerably increased and also the productivity to be deteriorated. In addition, the necessity of the thrust bearing in the compressor results in uneasiness in assembling the compressor and also an auxiliary burdensome in the tolerance management in the assemblage of the compressor.

SUMMARY OF THE INVENTION

It is, therefore, an object of this invention to provide an apparatus for lubricating the scroll-type compressor in which the above disadvantage can be overcome and which includes at least one lubricating passage provided in the orbiting scroll in order to guide the lubricant which is upwardly pumped as a crankshaft rotates toward a thrust bearing surface of a main frame through the inside of the orbiting scroll, thereby supporting the thrust of the orbiting scroll by lubricating apparatus of a relatively simple construction having no thrust bearing.

In accordance with the apparatus which is capable of accomplishing the above object of this invention, the main frame is provided with a main bearing which is mounted on a middle part of the main frame and a thrust bearing surface which is formed on an upper surface of the main frame and includes an annular lubricating groove. The thrust bearing surface allows the orbiting scroll to perform the orbital motion thereof under the condition that the lower surface thereof sliding-contacts with the thrust bearing suface.

In addition, the orbiting scroll is provided therein with an inside lubricating passage which communicates with the axial lubricating passage of the crankshaft in order to guide the lubricant which upwardly flows along the axial lubricating passage of the crankshaft toward the thrust bearing surface of the main frame. The inside lubricating passage comprises a radially formed horizontal passage and a lower vertical passage communicating with the annular lubricating groove on the thrust bearing surface of the main frame.

In accordance with the embodiments of this invention, the inside lubricating passage of the orbiting scroll may comprise at least one lubricating passage as desired, for example, the lubricating passage may comprise two passages which are formed as disposed at every 180° angle or three passages which are formed as disposed at every 120° angle on the basis of the center of the orbiting scroll.

In addition, the orbiting scroll has at the lower surface thereof an annular lubricating groove for supplying the lubricant from the lower vertical passage of the lubricating passage of the orbiting scroll to the thrust bearing surface of the main frame. In result, the orbiting scroll performs the orbital motion under the condition that the lower surface thereof is smoothly supported by the lubricant supplied onto the thrust bearing surface of the main frame.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
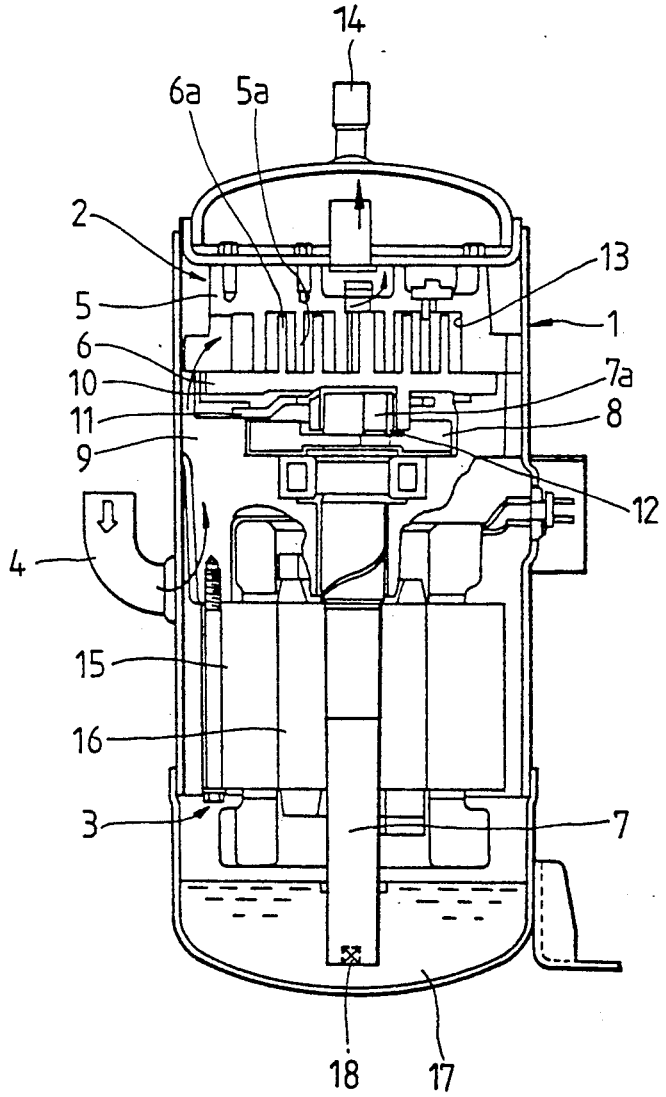
FIG. 1 (PRIOR ART)
FIG. 1 is a sectional view showing an inner construction of a known scroll-type compressor.
Figure 2:
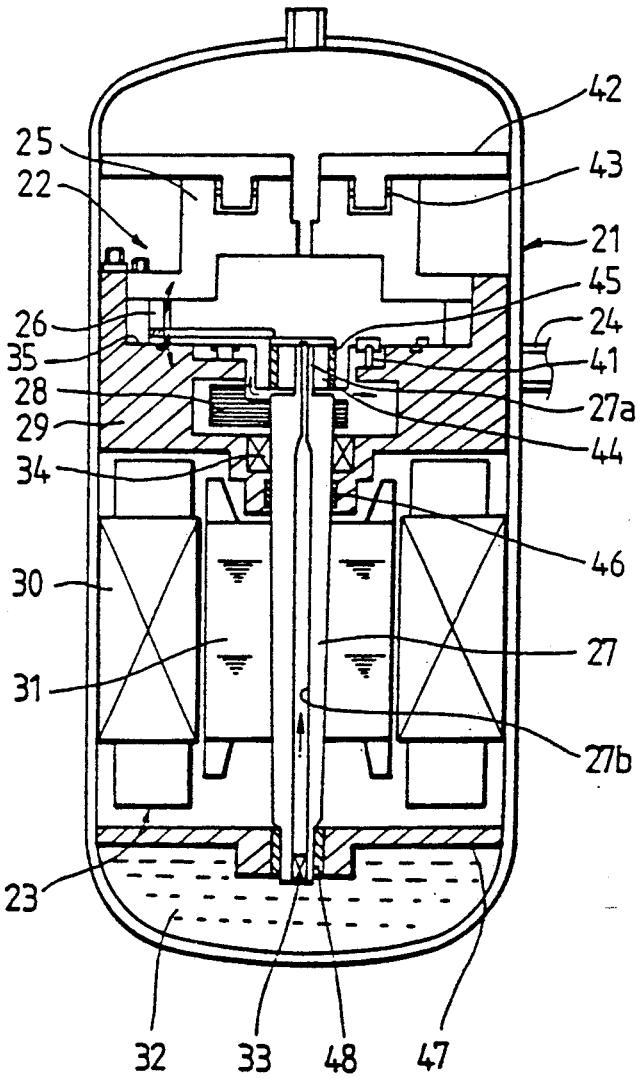
FIG. 2 is a view corresponding to FIG. 1, but showing a compressor provided with lubricating apparatus according to the present invention.

Referring first to FIG. 2 which is a sectional view showing an inner construction of a scroll-type compressor provided with a lubricating apparatus according to this invention, the compressor generally comprises a compressing part 22 and a driving motor part 23, each enclosed in an airtight shell 21. In addition, the compressor is provided with a fluid passage for guiding the fluid, for example, a refrigerant gas, the passage communicating with a suction pipe 24.

The compressing part 22 comprises a stationary scroll 25, an orbiting scroll 26 which is interleaved with the stationary scroll 25, a crankshaft 27 for driving the orbiting scroll 26 in order to cause the scroll 26 to orbit and having an uppermost end thereof an eccentric shaft pin 27*a*, a balance weight 28, and a main frame 29 for supporting the above-mentioned elements. On the other hand, the driving motor part 23 comprises a stator 30 and a rotor 31.

On the other hand, the airtight shell 21 includes a lubricant reservoir 32 for containing the lubricant. The crankshaft 27 is provided at a lower end thereof with an oil pump 33 which is sunk in the lubricant in the reservoir 32.

The above-mentioned construction of the compressor is similar to the conventional construction as described in the description of the prior art.

Figure 3:
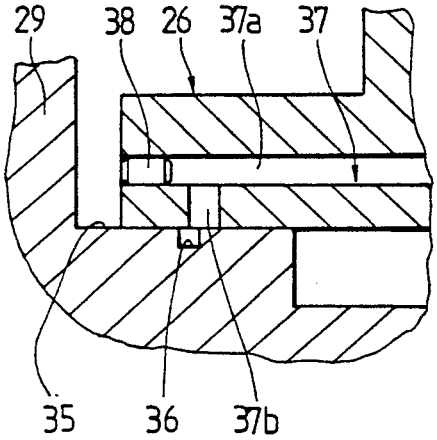
FIG. 3 is an enlarged sectional view of the lubricating apparatus of FIG. 2.

In accordance with this invention, the scroll-type compressor is additionally provided with the lubricating apparatus in which the main frame 29 having a main bearing 34 at a middle part thereof has at an upper surface thereof a thrust bearing surface 35 as represented in FIG. 3 which is an enlarged sectional view of the lubricating apparatus. Here, the orbiting scroll 26 performs the orbital motion thereof under the condition that the lower surface thereof sliding-contacts with the thrust bearing surface 35 of the main frame 29.

Figure 5:
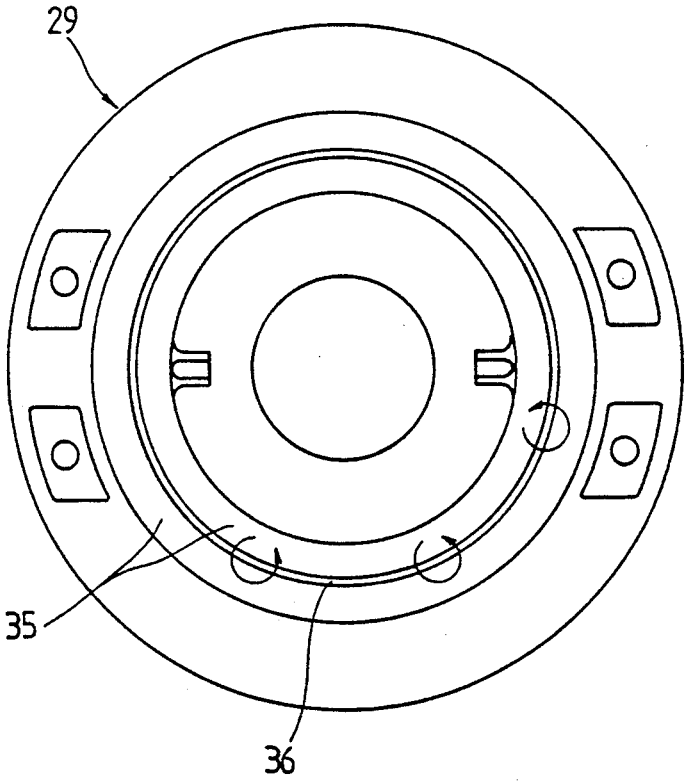
FIG. 5 is a plane view showing a main frame of the scroll-type compressor according to this invention.

On the other hand, the thrust bearing surface 35 is provided on the upper surface thereof with an annular lubricating groove 36 as shown in FIG. 5 which is a plane view showing the main frame.

Figure 6:
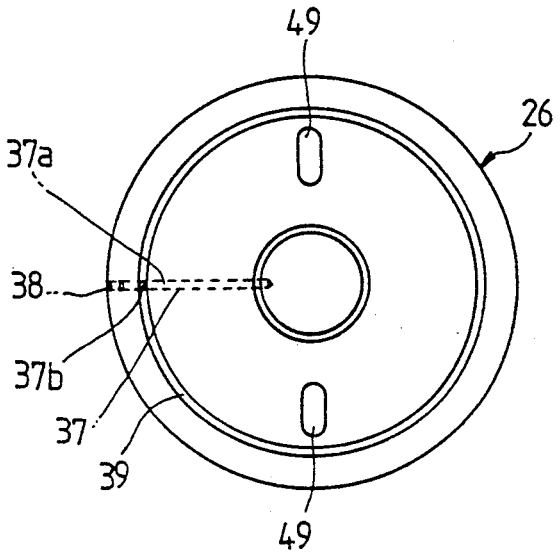
FIG. 6 is a bottom view showing an orbiting scroll of the scroll-type compressor according to this invention.

With reference to FIG. 6 which is a bottom view showing an embodiment of an orbiting scroll according to this invention, the orbiting scroll 26 includes therein an inside lubricating passage 37 for guiding the lubricant which upwardly flows along an axial lubricating passage 27*b*(see FIG. 2) of the crankshaft 27 toward the thrust bearing surface 35 of the main frame 29.

Turning again to FIGS. 3 and 4, the inside lubricating passage 37 of the orbiting scroll 26 comprises a horizontal passgae 37*a* having a predetermined diameter $\phi_D$ and a lower vertical passage 37*b* having a predetermined diameter $\phi_C$. The horizontal passage 37*a* is radially formed as outwardly extending from the inner center of the orbiting scroll 26 and has a stop pin 38 which is inserted into the outermost end thereof in order to restrain the lubricant from being leaked out of the scroll 26. On the other hand, the vertical passage 37*b* is vertically formed as downwardly extending from an end portion of the horizontal passage 37*a* near the stop pin 38 in order to partially overlap with the annular lubricating groove 36 of the main frame 29.

Figure 7:
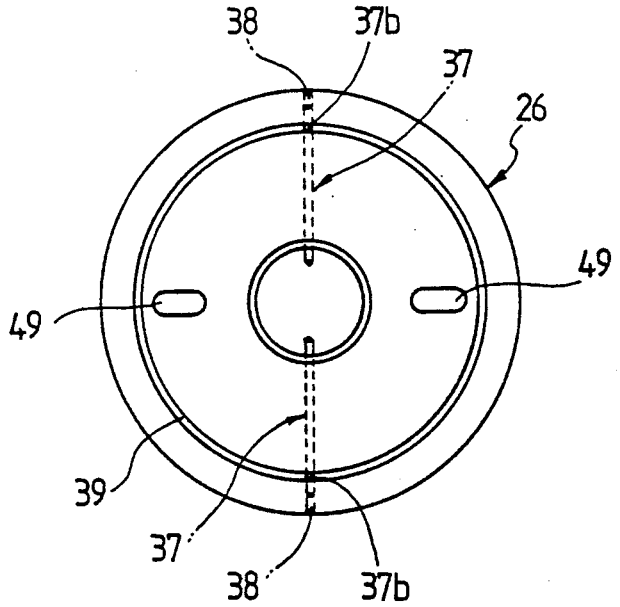
FIG. 7 is a view corresponding to FIG. 6, but showing another embodiment of an orbiting scroll according to this invention.

Here, the lubricating passage 37 may comprise, as shown in FIG. 7, two passages which are formed as oppositely and radially disposed on a center line of the orbiting scroll 26 in order to be disposed at every 180° angle on the basis of the center of the scroll 26. In addition, the number of the inside lubricating passage 37 of the orbiting scroll 26 may comprise at least one passage as desired.

As shown in FIGS. 6 and 7, the orbiting scroll 26 has at the lower surface therof an annualar lubricating groove 39 for supplying the lubricant from the lower vertical passage 37*b* to the thrust bearing surface 35 of the main frame 29, which groove 39 is formed as overlapping with the lower vertical passage 37*b* of the orbiting scroll 26.

Figure 4:
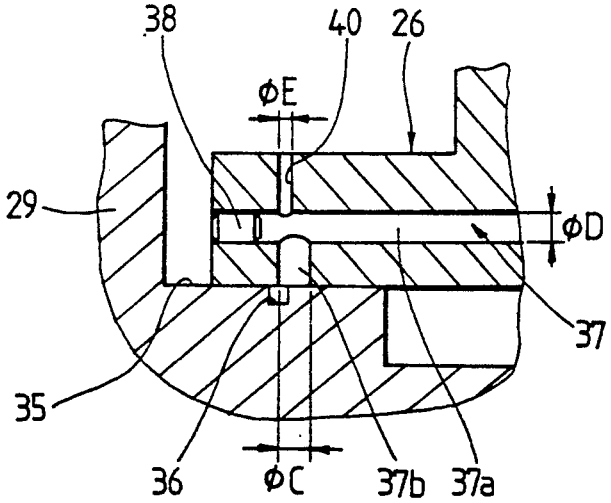
FIG. 4 is a view corresponding to FIG. 3, but showing another embodiment of lubricating apparatus of this invention.

On the other hand, the orbiting scroll 26 may have an upper vertical passage 40 of a predetermined diameter $\phi_E$ as shown in FIG. 4, which passage 40 is formed as upwardly extending from an outer end portion of the horizontal passage 37*a* near the stop pin 38 in order to communicate with a lower surface of the stationary scroll 25.

In the drawings, the reference numerals each denotes such as an Oldham coupling 41, an upper partition 42, an O-ring 43, an eccentric bushing 44, an orbiting bushing 45, a main frame bushing 46, a lower frame 47, a lower frame bushing 48 and an Oldham's coupling guide 49.

The operational effect of the lubricating apparatus of the scroll-type compressor of this invention will be described as follows.

With reference to FIG. 2, as the crankshaft 27 is first rotated by the driving motor part 23, the oil pump 33 mounted on the lower end of the crankshaft 27 pumps the lubricant in the reservoir 32 in order to cause the lubricant to upwardly flow along the axial lubricating passage 27*b* of the crankshaft 27. The lubricant is then guided along the horizontal and lower vertical passages 37*a* and 37*b* of the inside lubricating passage 37 of the orbiting scroll 26, sequentially, in order to at last reach the annular lubricating groove 36 and the thrust bearing surface 35 of the main frame 29.

In accordance, the orbiting scroll 26 smoothly performs the orbital motion thereof under the condition that it is smoothly supported in the thrust thereof by means of the thrust bearing surface 35 of the main frame 29 which is sufficiently supplied with the lubricant as described above.

At this time, the Oldham coupling 41 which is disposed between the orbiting scroll 26 and the main frame 29 efficiently restrains the orbiting scroll 26 from freely rotating. In accordance, the orbiting scroll 26 can perform the normal orbital motion thereof caused by the eccentric rotation of the crankshaft 27.

On the other hand, the lubricating apparatus of this invention may include at least two lubricating passages 37, as shown in FIG. 7, and also the upper vertical passage 40 which is formed as upwardly extending from the lubricating passage 37 in order to communicate with the lower surface of the stationary scroll 25, as shown in FIG. 4, thereby causing the operational effect thereof to be increased due to the improvement of the orbital motion of the orbiting scroll 26.

In FIG. 5, the arrow marks represent the relative movement of an optional point of a lower surface of the orbiting scroll 27 with respect to the thrust bearing surface 35 of the main frame 29.

As described above, the present invention provides lubricating apparatus of a scroll-type compressor in which the orbiting scroll is provided therein with at least one lubricating passage for guiding the lubricant from the axial lubricating passage of the crankshaft to the thrust bearing surface of the main frame, thereby efficiently supporting the thrust of the orbiting scroll during the orbital motion of the orbiting scroll. In result, the lubricating apparatus of the present invention has advantages it that is simplifies the construction of the compressor, reduces the manufacturing cost, and facilitates the assembling process of the compressor and also reduces the number of the elements of the compressor, thereby facilitating the tolerance management in the assemblage of the compressor.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A lubricating apparatus of a scroll-type compressor comprising:

a main frame;

a thrust bearing surface provided on the main frame, said surface having a lubricating groove thereon;

an orbiting scroll for performing an orbital motion under the condition of slide contacting at a lower surface thereof with said thrust bearing surface;

a crankshaft having an axial lubricating passage;

lubricating passage means included in said orbiting scroll and communicating with said axial lubricating passage of the crankshaft, said lubricating passage means including a first lubricating passage having a horizontal passage and a lower vertical passage, said horizontal passage being radially formed as outwardly extending from the inner center of said orbiting scroll and having a stop pin which is inserted into the outer end of said horizontal passage, and said lower vertical passage being vertically formed as extending from said horizontal passage in order to communicate with said lubricating groove of the main frame; and a second lubricating groove for supplying the lubricant to said thrust bearing surface of the main frame, said second lubricating groove formed on a lower surface of the orbiting scroll as overlapping with said lower vertical passage.

2. The apparatus according to claim 1, wherein said lubricating passage means comprises at least one additional first lubricating passage.

3. The apparatus according to claim 1, including a stationary scroll and wherein said lubricating passage means comprises an upper vertical passage formed as communicating with a lower surface of said stationary scroll which is interleaved with said orbiting scroll.

4. The apparatus according to claim 1, wherein said lubricating groove of the thrust bearing surface has an annular shape.

* * * * *